United States Patent [19]

Tsuchihashi et al.

[11] 4,138,714

[45] Feb. 6, 1979

[54] METHOD OF LIGHTING FOR COLORED SHADOWS

[75] Inventors: Michihiro Tsuchihashi; Masato Saito; Makoto Yamanoshita, all of Amagasaki; Hidetoshi Katsura, Kamakura; Osamu Myodo, Kamakura; Koichiro Maeyama, Kamakura, all of Japan

[73] Assignee: Mitsubishi Denki Kabushiki Kaisha, Tokyo, Japan

[21] Appl. No.: 798,459

[22] Filed: May 19, 1977

[30] Foreign Application Priority Data

Oct. 25, 1976 [JP] Japan ..... 51-128035

[51] Int. Cl.[2] ..... F21P 5/04

[52] U.S. Cl. ..... 362/231; 362/811; 362/228

[58] Field of Search ..... 362/125, 227, 230, 231; 272/9, 10; 356/190, 191, 195

[56] References Cited

U.S. PATENT DOCUMENTS

| | | | |
|---|---|---|---|
| 3,501,852 | 3/1970 | Hartel et al. | 356/191 X |
| 3,816,739 | 6/1974 | Stolov | 362/231 |
| 3,945,729 | 3/1976 | Rosen | 356/195 X |

*Primary Examiner*—Gerald Goldberg
*Assistant Examiner*—Peter S. Wong
*Attorney, Agent, or Firm*—Oblon, Fisher, Spivak, McClelland and Maier

[57] ABSTRACT

Beautifully and balancedly colored shadows can be imparted by arranging color lamps in three R, G and B groups, illuminating an object to obtain colored shadows of the object to give the ratios of illuminances by the color light lamps;

$$i_R = \frac{I_R}{I_R + I_G + I_B}$$

$$i_G = \frac{I_G}{I_R + I_G + I_B}$$

$$i_B = \frac{I_B}{I_R + I_G + I_B}$$

in a range surrounded by the following ratios of j-k-l-m-n-e-f-j in the triangular coordinate of FIG. 2 wherein $I_R$ designates an illuminance by only the lamp in the R group; $I_G$ designates an illuminance by only the lamp in the G group and $I_B$ designates an illuminance by only the lamp in the B group.

| Symbol | $i_R$ | $i_G$ | $i_B$ |
|---|---|---|---|
| j | 0.78 | 0.2 | 0.02 |
| k | 0.65 | 0.2 | 0.15 |
| l | 0.65 | 0.05 | 0.3 |
| m | 0.55 | 0.05 | 0.4 |
| n | 0.2 | 0.4 | 0.4 |
| e | 0.05 | 0.8 | 0.15 |
| f | 0.18 | 0.8 | 0.02 |

3 Claims, 2 Drawing Figures

METHOD OF LIGHTING FOR COLORED SHADOWS

BACKGROUND OF THE INVENTION

The present invention relates to an improved method of lighting for colored shadows, more particularly, it relates to a method of illuminating an object by a plurality of color light sources at ratios of illuminances by the color light sources to obtain the optimumly beautifully colored shadows of the object and to give the appearance of the object being substantially the same with the original color.

When an object on a white floor is illuminated by a plurality of color lamps, the colored shadows of the object are formed behind the object.

When a shadow formed by one color lamp is illuminated by another color lamp, a colored shadow is obtained depending upon the characteristic of the light illuminating the part that is the characteristic of the color lamp.

When a shadow formed by one color lamp is illuminated by the other two kinds of the color lamps, colored shadows having a different color from those of the lights of the color lamps, are obtained by mixing the lights of the two color lamps.

The inventors have studied how to obtain beautifully and balancedly colored shadows by selecting ratios of luminances by the color lamps and have found the desired ranges of ratios of luminances by the color lamps. (Japanese Patent Application No. 101,482/1975).

The specific ranges are suitable for attaining beautifully and balancedly colored shadows. However, the specific ranges have not been satisfactory to give an appearance of the object being substantially the same with the original color together with beautifully and balancedly colored shadows.

SUMMARY OF THE INVENTION

It is a purpose of the present invention to provide a method of lighting for imparting beautifully and balancedly colored shadows together with an appearance of the object being substantially the same with the original color.

The purpose of the present invention can be attained by providing a method of lighting for colored shadows by arranging color light sources in three R, G and B groups of at least one light source for yellow to red (R group); at least one light source for green (G group) and at least one light source for violet to blue (B group) and illuminating an object to obtain colored shadows of the object to give the ratios of illuminances by the color light sources;

$$i_R = \frac{I_R}{I_R + I_G + I_B}$$

$$i_G = \frac{I_G}{I_R + I_G + I_B}$$

$$i_B = \frac{I_B}{I_R + I_G + I_B}$$

in a range surrounded by the following ratios of j-k-l-m-n-e-f-j in a triangular coordinate wherein $I_R$ designates an illuminance by only the lamp in the R group; $I_G$ designates an illuminance by only the lamp in the G group and $I_B$ designates an illuminance by only the lamp in the B group.

| Symbol | $i_R$ | $i_G$ | $i_B$ |
|---|---|---|---|
| j | 0.78 | 0.2 | 0.02 |
| k | 0.65 | 0.2 | 0.15 |
| l | 0.65 | 0.05 | 0.3 |
| m | 0.55 | 0.05 | 0.4 |
| n | 0.2 | 0.4 | 0.4 |
| e | 0.05 | 0.8 | 0.15 |
| f | 0.18 | 0.8 | 0.02 |

DETAILED DESCRIPTION OF THE PREFERRED EMBODIMENTS

Figure 1:
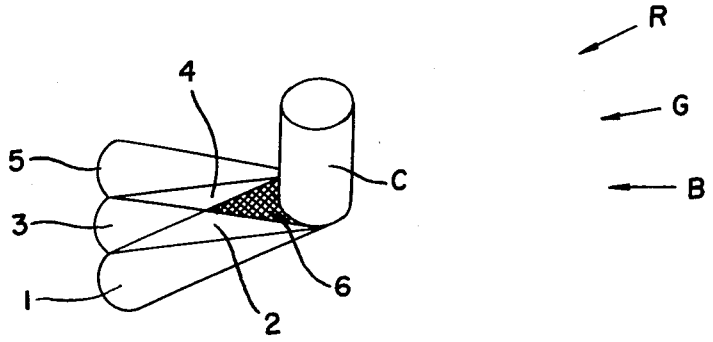
FIG. 1 is a schematic view showing the condition of the colored shadows on a floor which are attained by illuminating a cylindrical object (C) on a white floor by the color lamps in the three R, G and B groups.

In the specification, the light sources are described as lamps.

The color lamps in the R group include a yellow color lamp, an orange color lamp, a red color lamp, a high pressure sodium lamp, an orange metal halide lamp (sodium halide is added) and a red metal halide lamp (lithium halide is added), and the light sources, devices, for orange to red color which have a front colored filter, glass plate, plastic film and so on, to give color lights being the same with as those of the color lamps.

The color lamps in the G group include a green color lamp and a green metal halide lamp (thallium halide is added), and the light sources, devices, for green which have a front colored filter to give color lights being the same as those of the color lamps.

The color lamps in the B group include a violet color lamp, a blue color lamp, a violet metal halide lamp (gallium halide is added) and a blue metal halide lamp (indium halide is added), and the light sources, devices, for violet to blue which have a front colored filter plate to give color lights being the same as those of the color lamps.

The light sources for middle colors in the three R, G and B groups such as yellowish green, bluish green and reddish violet can be classified as the R group or the G group for a yellowish green light source; the G group or the B group for a bluish green light source and the B group or the R group for a reddish violet light source.

Referring to the drawings, the embodiment of the invention will be illustrated.

FIG. 1 is a schematic view of one embodiment of the present invention to show the colored shadows which are cast on the white floor by illuminating a cylindrical object (C) on a white floor by using the high pressure sodium lamp as the light source in the R group; the blue metal halide lamp (indium halide is added) as the light source in the B group, and the green metal halide lamp (thallium halide is added) as the light source in the G group.

In the colored shadows, the part (1) is colored bluish green; the part (2) is colored blue; the part (3) is colored pink; the part (4) is colored orange; the part (5) is colored yellow and the part (6) is black shadow.

The part (1) is the shadow of the object (C) to the light of the lamp R and is colored bluish green by mixing the lights of the lamps G, B. The part (2) is the shadow of the object (C) to both of the lights of the lamps R, G and is colored blue under the illumination of the lamp B. The part (3) is a shadow of the object (C) to the light of the lamp G and is colored pink by mixing the lights of the lamps R, B. The part (4) is a shadow of the object (C) to both of the lights of the lamps G, B and is colored orange under the illumination of the lamp R. The part (5) is a shadow of the object (C) to the light of the lamp B and is colored yellow by mixing the lights of the lamps R, G.

The beautifully and balancedly colored shadows are obtained when the ratios of luminances $i_R$, $i_G$, $i_B$ by the lamps in the R, G and B groups at the position forming the colored shadows are in the specific ranges surrounded by the ratios of a-b-c-d-e-f-a.

However, the object is not always illuminated in white and is colored even though the ratios of illuminances $i_R$, $i_G$ and $i_B$ are in the ranges surrounded by the ratios of a-b-c-d-e-f-a. When the object is colored red, orange, yellow, green, blue or violet and so on, the color of the object is changed disadvantageously even though the beautifully colored shades are obtained.

Figure 2:
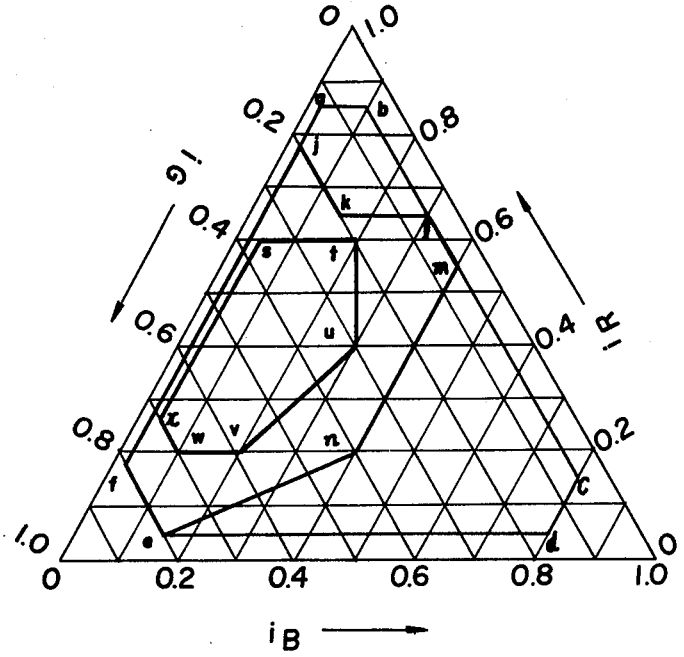
FIG. 2 is a triangular coordinate for illustrating the specific ranges of ratios of $i_R$, $i_G$ and $i_B$.

The inventors have studied how to overcome the disadvantages to give an appearance of the object having its precise original color with repeating experiments. As the result, the inventors have found that the optimum beautifully and balancedly colored shadows are obtained together with an appearance of the object being substantially the same with the original color when the ratios of luminances $i_R$, $i_G$ and $i_B$ are in the specific ranges surrounded by the ratios of j-k-l-m-n-e-f-j in the triangular coordinate of FIG. 2.

An appearance of the object is further close to the original color of the object when the ratios of luminances $i_R$, $i_G$ and $i_B$ are in the specific ranges surrounded by the ratios of s-t-u-v-w-x-s.

When the ratios $i_R$, $i_G$ and $i_B$ are in the ranges surrounded by the ratios of j-k-l-m-n-e-f-j, the general color rendering index Ra of the light sources in the combination of the lights by the light sources in the three R, G and B groups on the surface illuminated by the three light sources is more than about 40.

When the ratios $i_R$, $i_G$ and $i_B$ are in the ranges surrounded by the ratios of s-t-u-v-w-x-s, the general color rendering index Ra of the light sources is more than about 60.

The ratios of illuminances of the color light sources on the illuminated surface $i_R$, $i_G$ and $i_B$ are given by the equations $$i_R = \frac{I_R}{I_R + I_G + I_B}$$

$$i_G = \frac{I_G}{I_R + I_G + I_B}$$

$$i_B = \frac{I_B}{I_R + I_G + I_B}$$

wherein $I_R$ designates an illuminance by only the lamp in the R group; $I_G$ designates an illuminance by only the lamp in the G group and $I_B$ designates an illuminance by only the lamp in the B group. In the triangular coordinate of FIG. 2, a, b, c, d, e, f, j, k, l, m, n, s, t, u, v, w and x are as shown in Table 1.

| Symbol | $i_R$ | $i_G$ | $i_B$ |
|---|---|---|---|
| a | 0.85 | 0.13 | 0.02 |
| b | 0.85 | 0.05 | 0.1 |
| c | 0.15 | 0.05 | 0.8 |
| d | 0.05 | 0.15 | 0.8 |

-continued

| Symbol | $i_R$ | $i_G$ | $i_B$ |
|---|---|---|---|
| e | 0.05 | 0.8 | 0.15 |
| f | 0.18 | 0.8 | 0.02 |
| j | 0.78 | 0.2 | 0.02 |
| k | 0.65 | 0.2 | 0.15 |
| l | 0.65 | 0.05 | 0.3 |
| m | 0.55 | 0.05 | 0.4 |
| n | 0.2 | 0.4 | 0.4 |
| s | 0.6 | 0.36 | 0.04 |
| t | 0.6 | 0.2 | 0.2 |
| u | 0.4 | 0.3 | 0.3 |
| v | 0.2 | 0.6 | 0.2 |
| w | 0.2 | 0.7 | 0.1 |
| x | 0.26 | 0.7 | 0.04 |

The $i_R$, $i_G$ and $i_B$ are ratios of illuminances by the color lamps in the three R, G and B groups. Accordingly, in the measurements of illuminances $I_R$, $I_G$ and $I_B$, the positions for independently measuring the illuminance $I_R$ by only the lamp in the R group, the illuminance $I_G$ by only the lamp in the G group and the illuminance $I_B$ by only the lamp in the B group are selected. The illuminances $I_R$, $I_G$ and $I_B$ are different but the ratios of illuminances $i_R$, $i_G$, $i_B$ are respectively constants on the surface of colored shadows or the surface of the object when the outputs of the color lamps and the positions of the color lamps are determined.

In the embodiment, a high pressure sodium lamp is used as the color light source in the R group, a green metal halide lamp (thallium halide is added) is used as the color light source in the G group and a blue metal halide lamp (indium halide is added) is used as the color light source in the B group and these lamps are arranged in the order of R-G-B in transverse line and the object (C) is illuminated from the rear upper part to obtain the colored shadows on the white floor.

Thus, the substantially same effect can be attained by selecting the specific ratios $i_R$, $i_G$ and $i_B$ even though the other color light sources in the R, G and B groups are used.

The arrangement of the light sources in the R, G and B groups can be selected as desired depending upon the shape and arrangement of colors of the object and the colored shadows.

Various variations depending upon the movements of the colored shadows can be given by using the structures of the color light sources and the object which are independently or simultaneously moved.

The place for forming the colored shadows of the object by the color light sources is not limited to the white floor and the method of the invention can be applied for outdoor lightings in skiing fields, skating rinks or park fields and indoor lightings in show-windows, stages, coffee-shops, displays or studios.

If necessary, it is possible to illuminate the object and the colored shadows by another light source with said color light sources in a degree to cause no damage of effect of the invention.

In the embodiment, one color lamp per each of the R, G and B groups is used. Thus, it is possible to use a plurality of color lamps for each of the R, G and B groups depending upon the purpose and the region of the illumination by the color light sources. The wattages of the color lamps can be selected as desired.

As described above, in accordance with the present invention, the beautifully colored shadows are obtained together with an appearance of the object being substantially the same with the original color by specifying the ratios of illuminances by the light sources in the R, G and B groups.

It is possible to impart the marvelous effect of illumination which could not be found by the conventional method.

What is claimed is:

1. A method of lighting for colored shadows which comprises arranging color light sources in three R, G and B groups of at least one light source for yellow to red (R group); at least one light source for green (G group) and at least one light source for violet to blue (B group) and illuminating an object to obtain colored shadows of the object to give the ratios of illuminances by the color light sources;

$$i_R = \frac{I_R}{I_R + I_G + I_B}$$

$$i_G = \frac{I_G}{I_R + I_G + I_B}$$

$$i_B = \frac{I_B}{I_R + I_G + I_B}$$

in a range surrounded by the following ratios of j-k-l-m-n-e-f-j in a triangular coordinate wherein $I_R$ designates an illuminance by only the lamp in the R group; $I_G$ designates an illuminance by only the lamp in the G group and $I_B$ designates an illuminance by only the lamp in the B group.

| Symbol | $i_R$ | $i_G$ | $i_B$ |
|---|---|---|---|
| j | 0.78 | 0.2 | 0.02 |
| k | 0.65 | 0.2 | 0.15 |

-continued

| Symbol | $i_R$ | $i_G$ | $i_B$ |
|---|---|---|---|
| l | 0.65 | 0.05 | 0.3 |
| m | 0.55 | 0.05 | 0.4 |
| n | 0.2 | 0.4 | 0.4 |
| e | 0.05 | 0.8 | 0.15 |
| f | 0.18 | 0.8 | 0.02 |

2. A method of lighting for colored shadows according to claim 1 wherein the ratios of illuminances $i_R$, $i_G$ and $i_B$ are in a range surrounded by the following ratios of s-t-u-v-w-x-s.

| Symbol | $i_R$ | $i_G$ | $i_B$ |
|---|---|---|---|
| s | 0.6 | 0.36 | 0.04 |
| t | 0.6 | 0.2 | 0.2 |
| u | 0.4 | 0.3 | 0.3 |
| v | 0.2 | 0.6 | 0.2 |
| w | 0.2 | 0.7 | 0.1 |
| x | 0.26 | 0.7 | 0.04 |

3. A method of lighting for colored shadows according to claim 1, wherein the light source in the R group is a yellow color lamp, an orange color lamp, a red color lamp, a high pressure sodium lamp, an orange metal halide lamp (sodium halide is added) and a red metal halide lamp (lithium halide is added), a lamp having a front orange-red colored filter; and the light source in the G group is a green color lamp and a green metal halide lamp (thallium halide is added), a lamp having a front green colored filter; and the light source in the B group is a violet color lamp, a blue color lamp, a violet metal halide lamp (gallium halide is added) and a blue metal halide lamp (indium halide is added), a lamp having a front violet-blue colored filter.

* * * * *